US012262805B2

(12) United States Patent
Lee et al.

(10) Patent No.: US 12,262,805 B2
(45) Date of Patent: Apr. 1, 2025

(54) REFILL UNIT AND REFILLABLE STICK CONTAINER HAVING THE SAME

(71) Applicant: SAMHWA CO., LTD, Uiwang-si (KR)

(72) Inventors: Kyungchang Lee, Uiwang-si (KR); Ho Sang Kang, Gunpo-si (KR); Kwan Ho Lee, Suwon-si (KR)

(73) Assignee: SAMHWA CO., LTD, Uiwang-si (KR)

( * ) Notice: Subject to any disclaimer, the term of this patent is extended or adjusted under 35 U.S.C. 154(b) by 42 days.

(21) Appl. No.: 18/352,027

(22) Filed: Jul. 13, 2023

(65) Prior Publication Data

US 2024/0335021 A1 Oct. 10, 2024

(30) Foreign Application Priority Data

Apr. 4, 2023 (KR) ..... 10-2023-0044234

(51) Int. Cl.

| | |
|---|---|
| ***A45D 40/16*** | (2006.01) |
| ***A45D 40/00*** | (2006.01) |
| ***A45D 40/04*** | (2006.01) |
| ***A45D 40/06*** | (2006.01) |
| ***A45D 40/20*** | (2006.01) |

(52) U.S. Cl.

CPC ..... *A45D 40/16* (2013.01); *A45D 40/06* (2013.01); *A45D 2040/0031* (2013.01); *A45D 2040/0062* (2013.01); *A45D 40/04* (2013.01); *A45D 2040/204* (2013.01)

(58) Field of Classification Search

CPC ..... A45D 40/16; A45D 40/06; A45D 2040/0031; A45D 2040/0062; A45D 40/00; A45D 40/02; A45D 40/04; A45D 2040/204; A45D 40/205

USPC ..... 401/75, 78, 87, 88, 171, 172, 174

See application file for complete search history.

(56) References Cited

U.S. PATENT DOCUMENTS

| | | | | |
|---|---|---|---|---|
| 5,399,040 A * | 3/1995 | Holloway | ..... | A45D 40/06 401/86 |
| 8,132,977 B2 * | 3/2012 | Pires | ..... | A45D 40/06 401/88 |
| 11,696,630 B1 * | 7/2023 | Liu | ..... | A45D 40/06 401/49 |

* cited by examiner

*Primary Examiner* — David J Walczak

(74) *Attorney, Agent, or Firm* — Bridgeway IP Law Group, PLLC; Jihun Kim

(57) ABSTRACT

A refill unit includes a lift shell and a holder. The lift shell includes: a shell cylinder, which is shaped as a hollow column to form a shell space with an insertion hole formed in a lower surface, and a shell coupler part, which extends downward around the insertion hole to form an enclosing space and has an outwardly protruding shell curb formed on a lower portion. The holder includes: a holder body arranged within the shell space; and a holder coupler part extending downwards from the holder body to be inserted through the insertion hole into the enclosing space. The holder coupler part has a holder space formed on the inside and an inwardly protruding holder curb formed on a lower portion, with the holder coupler part open towards the first direction.

9 Claims, 14 Drawing Sheets

REFILL UNIT AND REFILLABLE STICK CONTAINER HAVING THE SAME

CROSS-REFERENCE TO RELATED APPLICATIONS

This application claims the benefit of Korean Patent Application No. 10-2023-0044234, filed with the Korean Intellectual Property Office on Apr. 4, 2023, the disclosure of which is incorporated herein by reference in its entirety.

BACKGROUND

1. Technical Field

The present invention relates to a stick product, more particularly to a refill unit for refilling a stick product and a refillable stick container having the same.

2. Description of the Related Art

A stick product refers to a product that uses a stick material, which is obtained when a preparation containing the required components is congealed into a solid form. In general, a stick container for a stick product stores most of the stick material within the container but also includes a mechanism that can be manipulated by the user to expose a portion of the stick material to the outside as necessary. That is, as the stick product is used, the exposed top of the stick material is expended, and the upper portion of the stick material is worn away, so that the height of the stick material is gradually decreased. However, the stick container makes it possible to move the stick material further upward, such that the stick material can maintain an exposed state. In recent times, cosmetic products such as lipsticks and lip balms as well as various other products such as deodorants, glues, ointment, etc., are being provided in stick form.

A stick product is typically carried by the user and, as such, is manufactured in a comparatively small size. The small size of the stick product limits the amount of usable content and requires a higher level of precision in manufacturing the stick container. Since the use of the stick material requires a complicated structure as described above, the manufacturing cost may be higher compared to a regular container. In particular, in cases where the product is a cosmetic such as a lipstick, the stick container is often fabricated with a highly aesthetic design meeting consumer expectations, and this can further increase the manufacturing cost of the stick container. In view of the high cost and complicated structure with which the stick container is manufactured, a refillable structure that allows reusing the stick container even after the stick material is depleted would greatly reduce wasted resources.

Also, in a stick container based on the related art, the lower end of the stick material may be supported by a cup-shaped holder. In such cases, after the stick material is used for a prolonged period and expended and the cup-shaped holder is reached, there is difficulty in using the material located on the inside of the cup. The user is thus unable to completely use up the stick material and is forced to purchase a new product. Such occurrences of discarding products before the content is completely used up may add to the problems of wasted resources and environmental pollution.

SUMMARY OF THE INVENTION

An aspect of the present invention, which was conceived to resolve the problem described above, is to provide a refillable stick container.

Another aspect of the present invention is to provide a stick container that can minimize the unusable portion of the content of the stick product.

Other objectives of the present invention will be more clearly understood from the embodiments set forth below.

One aspect of the invention provides a refill unit configured to be coupled to a container assembly by a movement in a first direction. A refill unit according to an aspect of the invention can include: a lift shell forming a shell space on an inner side thereof that is open in an upward direction; and a holder arranged to be movable along a vertical direction within the shell space. Here, the lift shell can include: a shell cylinder, which may be shaped as a hollow column to form the shell space on an inner side thereof, and in a lower surface of which an insertion hole may be formed; and a shell coupler part, which may extend downward from the lower surface of the shell cylinder around the insertion hole to form an enclosing space on an inner side thereof, where the shell coupler part may have an outwardly protruding shell curb formed on a lower portion thereof that is open in the first direction such that the enclosing space is open in a downward direction and in the first direction. The holder can include: a holder body arranged within the shell space; and a holder coupler part extending downwards from the holder body to be inserted through the insertion hole into the enclosing space, where the holder coupler part may have a holder space formed on an inner side thereof and an inwardly protruding holder curb formed on a lower portion thereof, with the holder coupler part open in the first direction such that the holder space is open in a downward direction and in the first direction.

A refill unit according to an embodiment of the invention can include one or more of the following features. For example, the lift shell can further include a stopper block extending downwards from a lower portion at a side of the shell cylinder facing a second direction, where the stopper block may surround the side of the shell coupler part facing the second direction and may have a stopper surface facing the first direction formed on its side surface.

A detent protrusion can be formed on an outer perimeter of the shell coupler part.

The insertion hole can have a shape other than a circular shape such that the holder coupler part is able to pass through the insertion hole only when aligned in a particular direction.

Another aspect of the invention provides a refillable stick container that is configured to be coupled with a refill unit moving in a first direction, with the refillable stick container receiving the refill unit at a side facing a second direction. A refillable stick container according to this aspect of the invention can include: a container shaped as a hollow cylinder and forming an interior space on an inner side thereof that is open in an upward direction; a shaft coupled to the container such that the shaft is movable along a vertical direction in relation to the container; and a connector that is coupled to an upper portion of the container and has a through-hole formed therein to allow the shaft to pass through. Here, the connector can include: a connector base in which the through-hole is formed; and a connector coupler part extending upward from the connector base around the through-hole to form a coupling space on an inner side thereof, where the connector coupler part may have an inwardly protruding connector curb formed on an upper portion thereof, and the connector coupler part may be open in the second direction such that the coupling space is open in an upward direction and in the second direction.

A refillable stick container according to an embodiment of the invention can include one or more of the following features. For example, the connector coupler part can have a contact surface facing the second direction formed on its side surface, the refill unit can include a stopper block having a stopper surface facing the first direction, and when the refill unit is coupled, the stopper surface can press against the contact surface.

The shaft can include: an elongated body extending along the vertical direction and having a cross section of a shape other than a circular shape; a neck extending upward from an upper end of the elongated body and having a width smaller than a width of the elongated body; and a head formed on an upper portion of the neck and having a width greater than the width of the neck, while the refill unit can include a holder having a holder coupler part, where the holder coupler part can have a holder space formed on an inner side thereof and have an inwardly protruding holder curb formed on a lower portion thereof, with the holder coupler part open in the first direction such that the holder space is open in a downward direction and in the first direction. Thus, when the refill unit is coupled, the head of the shaft can be inserted into the holder space.

Also, the shaft can include: an elongated body that extends along the vertical direction, has a cross section of a shape other than a circular shape, and has an incision part formed in a lower end thereof; and a gear cog protruding outward from a lower portion of the elongated body, while the container can include: a socket having an internal screw formed in an inner side thereof; and a pressing protrusion protruding upward from a lower surface on an inner side of the socket at a position corresponding to the incision part.

Still another aspect of the invention provides a refillable stick container that includes: a lift shell forming a shell space on an inner side thereof that is open in an upward direction; a holder arranged to be movable along a vertical direction within the shell space, a container shaped as a hollow cylinder and forming an interior space on an inner side thereof that is open in an upward direction; a shaft coupled to the container such that the shaft is movable along the vertical direction in relation to the container; and a connector that is coupled to an upper portion of the container, has a through-hole formed therein to allow the shaft to pass through, and is configured to be coupled to the lift shell. Here, the lift shell can include: a shell cylinder shaped as a hollow column to form the shell space on an inner side thereof and having an insertion hole formed in a lower surface thereof; and a shell coupler part extending downward from the lower surface of the shell cylinder around the insertion hole to form an enclosing space on an inner side thereof, with the shell coupler part having an outwardly protruding shell curb formed on a lower portion thereof, and the shell coupler part being open in a first direction such that the enclosing space is open in a downward direction and in the first direction. The holder can include: a holder body arranged within the shell space; and a holder coupler part extending downwards from the holder body to be inserted through the insertion hole into the enclosing space, where the holder coupler part can have a holder space formed on an inner side thereof and an inwardly protruding holder curb formed on a lower portion thereof, and the holder coupler part can be open in the first direction such that the holder space is open in a downward direction and in the first direction. The connector can include: a connector coupler part that extends upward around the through-hole to form a coupling space on an inner side thereof, where the connector coupler part can have an inwardly protruding connector curb formed on an upper portion thereof, and the connector coupler part can be open in the second direction such that the coupling space is open in an upward direction and in the second direction.

An embodiment of the present invention having the features above can provide various advantageous effects including the following. However, an embodiment of the present invention may not necessarily exhibit all of the effects below.

Certain embodiments of the invention allow the user to completely use up the content of a stick container and further allow the user to continue using the stick container with refilled content. This makes it possible to reuse the parts of the stick container having a complicated structure and thus reduce costs for both the consumer and the manufacturer, reduce wasted resources, and reduce the pollution of the environment.

DETAILED DESCRIPTION OF THE INVENTION

Figure 1:
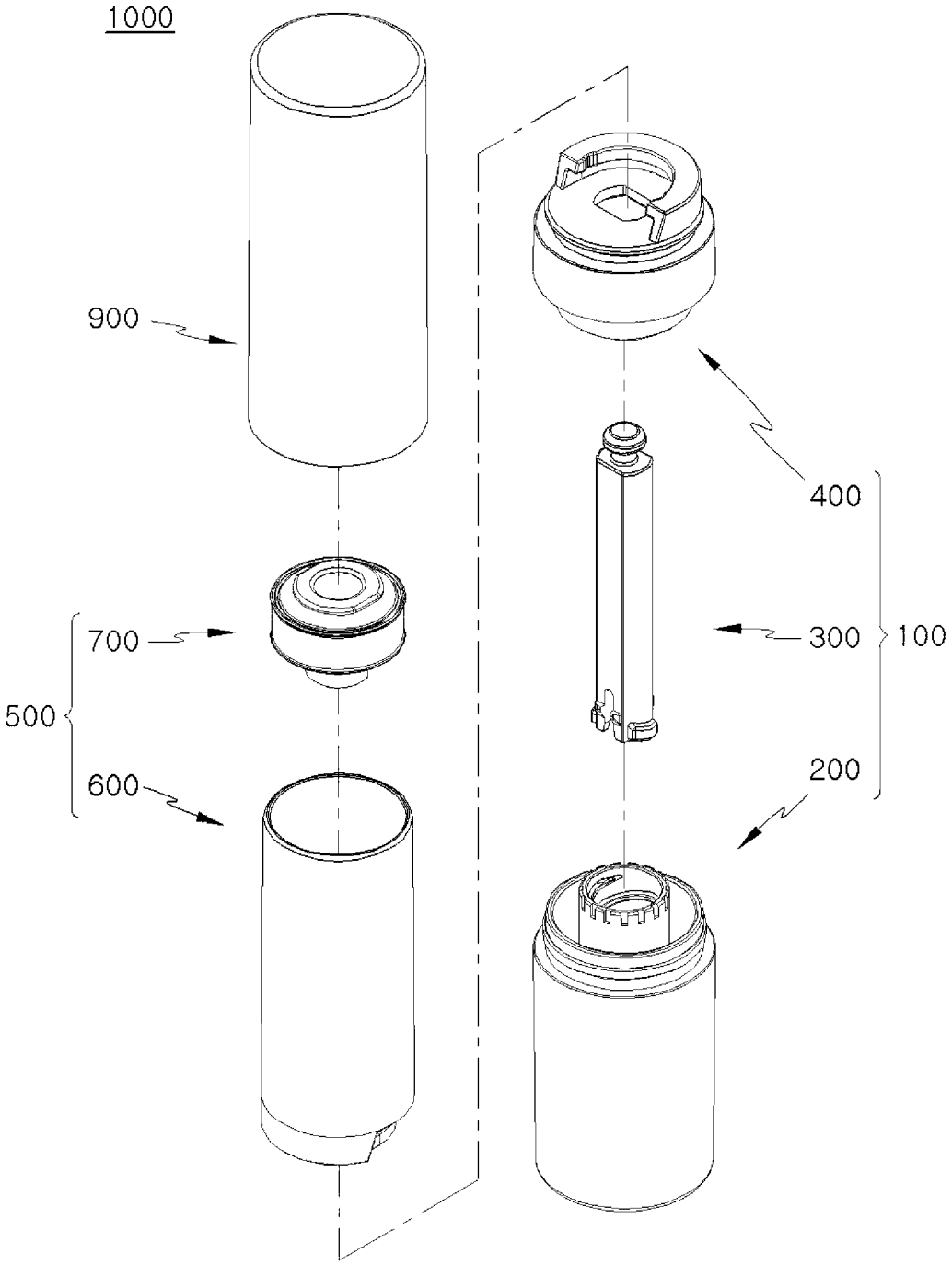
FIG. 1 is an exploded perspective view illustrating a stick container according to an embodiment of the invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," etc., can be used to describe various components, such components are not to be limited by the above terms. The above terms are used only to distinguish one component from another.

Certain embodiments of the present invention will be described below in more detail with reference to the accompanying drawings. Those components that are the same or are in correspondence are rendered the same reference numeral, and redundant descriptions are omitted.

Figure 2A:
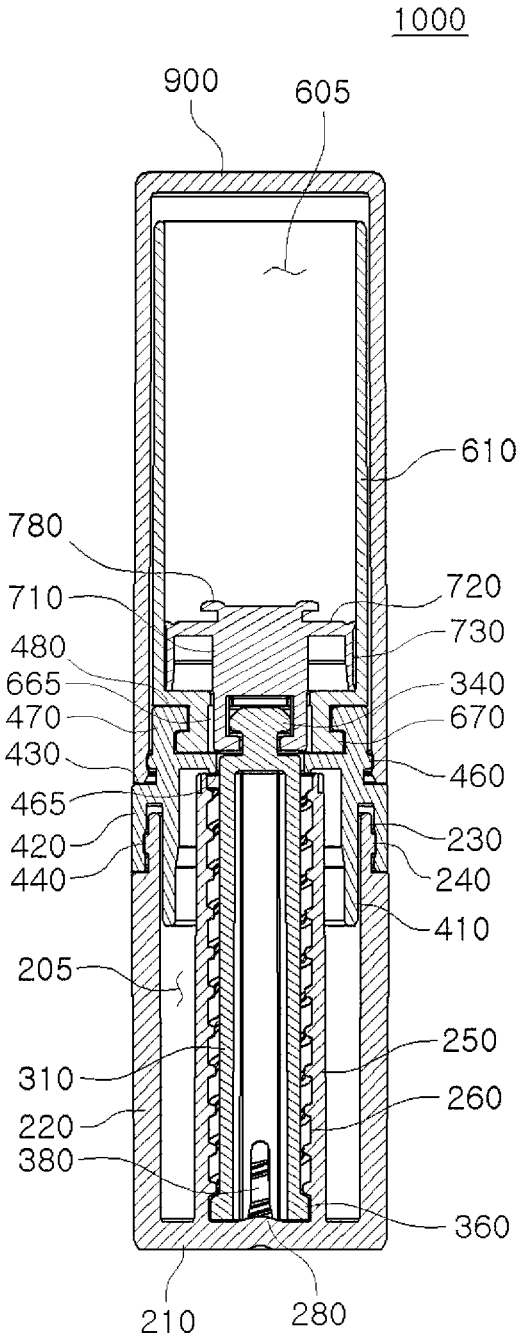
FIG. 2A and FIG. 2B are cross-sectional views illustrating a stick container according to an embodiment of the invention.
Figure 2B:
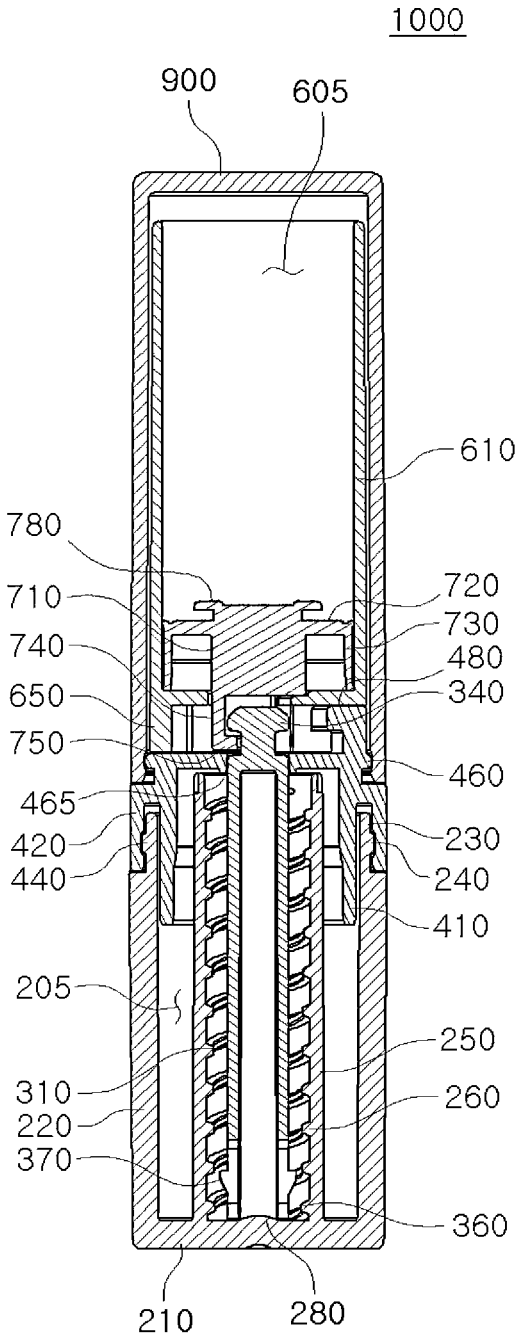
Figure 3A:
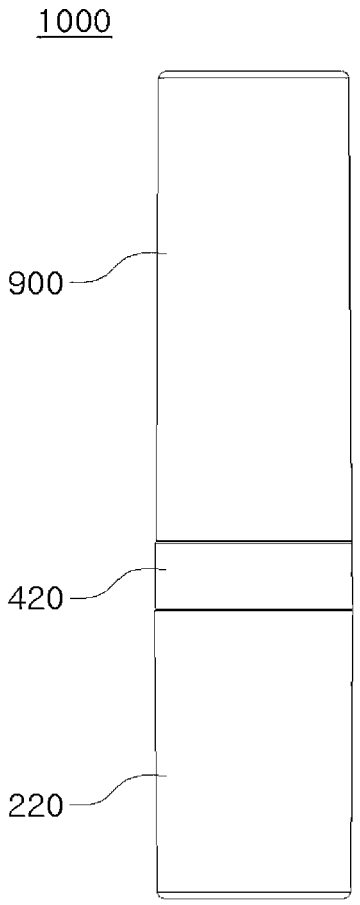
FIG. 3A and FIG. 3B are front views illustrating a stick container according to an embodiment of the invention.
Figure 3B:
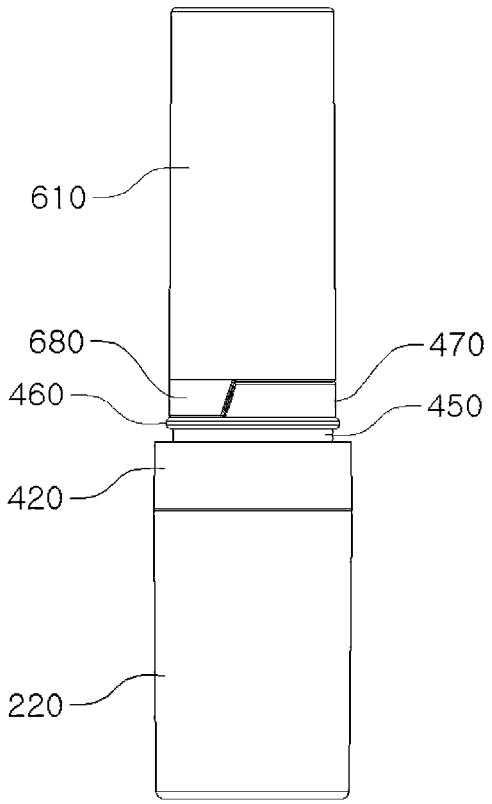
Figure 3C:
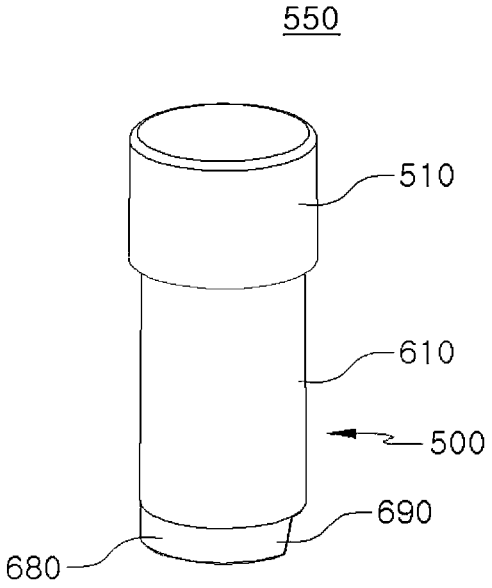
FIG. 3C is a perspective view of a refill unit according to an embodiment of the invention.
Figure 4A:
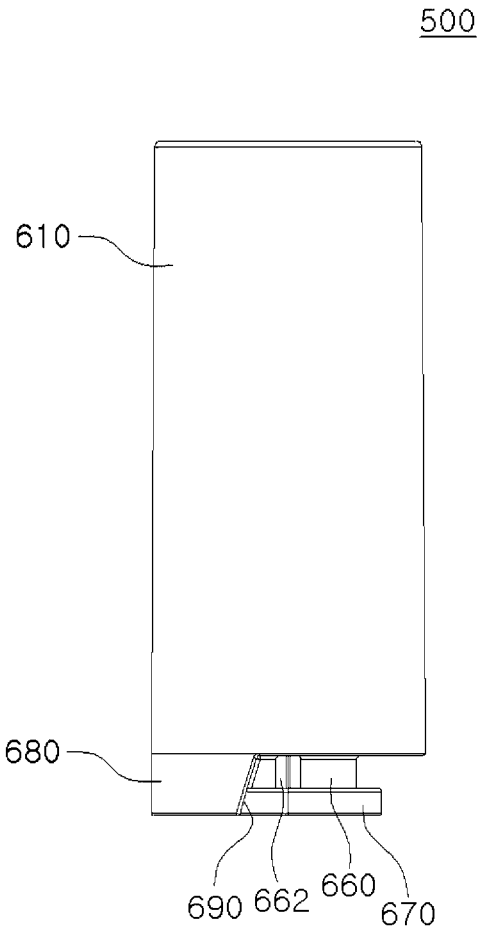
FIG. 4A and FIG. 4B illustrate the lift shell assembly of a stick container according to an embodiment of the invention.
Figure 4B:
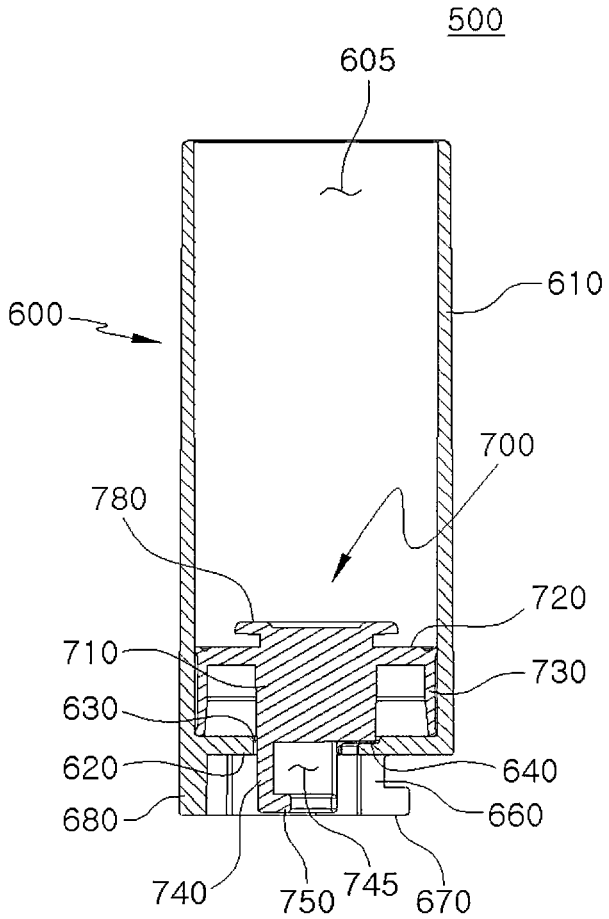
Figure 5A:
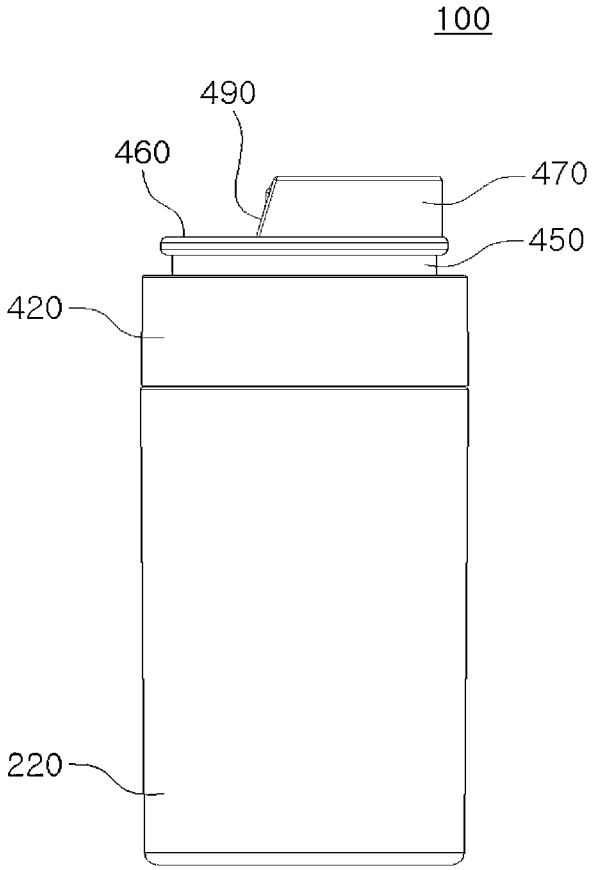
FIG. 5A and FIG. 5B illustrate the container assembly of a stick container according to an embodiment of the invention.
Figure 5B:
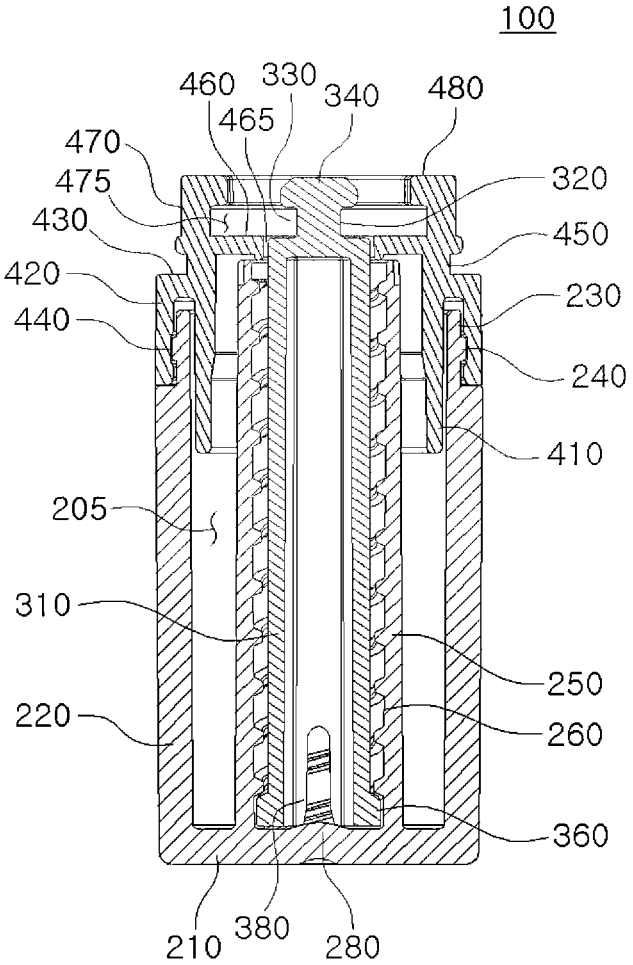

FIG. 1 is an exploded perspective view illustrating a stick container 1000 according to an embodiment of the invention, and FIG. 2A and FIG. 2B are cross-sectional views illustrating a stick container 1000 according to an embodiment of the invention. FIG. 3A, FIG. 3B, and FIG. 3C illustrate a stick container 1000 and a refill unit 550 according to an embodiment of the invention. FIG. 4A and FIG. 4B illustrate the lift shell assembly 500 of a stick container 1000 according to an embodiment of the invention, and FIG. 5A and FIG. 5B illustrate the container assembly 100 of a stick container 1000 according to an embodiment of the invention. Incidentally, FIG. 3A shows the stick container 1000 with the overcap 900 coupled on, FIG. 3B shows the stick container 1000 with the overcap 900 removed, and FIG. 3C shows the refill unit 550 with a refill cap 510 coupled on. In the present specification, a refill unit 550 can refer to the lift shell assembly 500 either with the refill cap 510 coupled on or with the refill cap 510 removed.

For the sake of convenience, the specification uses terms such as "one side," "other side," "inner," "outer," "upper," and "lower." In the descriptions that follow, "one side" or a side facing a "first direction" refers to the side facing the direction in which the lift shell assembly 500 is moved for coupling with the container assembly 100, whereas the "other side" or a side facing a "second direction" refers to its opposite direction. The term "inner side" refers to a side closer to the interior of the stick container 1000, while the term "outer side" refers to a side further from the interior of the stick container 1000. The terms "upper" and "lower" refer to the upper and lower orientations for a stick container 1000 arranged as in FIG. 2. Of course, during actual use of a stick container 1000 according to an embodiment of the invention, an upward direction mentioned in the specification may not necessarily coincide with the actual upward direction.

A stick container 1000 according to an embodiment of the invention may correspond to a container that holds and allows access to a stick material (not shown) such as a lipstick, lip balm, etc. The stick material (not shown) can be provided on a holder 700 on the inner side of a lift shell 600 and can be moved up and down as manipulated by the user. Referring to FIGS. 1 to 5B, a stick container 1000 according to an embodiment of the invention can mainly include a container assembly 100, a lift shell assembly 500, and an overcap 900.

With a stick container 1000 according to an embodiment of the invention, when the lift shell assembly 500 of the refill unit 550 is to be coupled to the container assembly 100, the user may move the lift shell assembly 500 towards one side such that the shell coupler part 660 engages the connector coupler part 470. When using a stick container 1000 according to an embodiment of the invention, the user may hold the lift shell 600 or the connector 400 with one hand, hold the container 200 with the other hand, and rotate these in relation to each other. Although the descriptions below will assume the case of the user rotating the container 200 while keeping the lift shell 600 stationary, it is just as well to regard the lift shell 600 as the component being rotated, since the lift shell 600 and the container 200 are rotated relative to each other.

The container assembly 100 of the stick container 1000 may serve to support the lift shell assembly 500 as well as to move the holder 700 up and down as manipulated by the user. The container assembly 100 can include a container 200, a shaft 300, and a connector 400.

The container 200 can serve to house and support other components of the container assembly 100 and can also correspond to the part gripped by the user when manipulating a stick container 1000 according to an embodiment of the invention. At least a portion of the container 200 can be shaped as a hollow cylinder, and an interior space 205 that opens upward can be formed on the inner side of the container 200. The container 200 can include a lower member 210, a side wall 220, and a socket 250.

The lower member 210 can form the lower surface of the container 200. Although the lower member 210 is not limited to a particular shape, the lower member 210 can have a circular shape when viewed along the vertical direction.

The side wall 220 can extend upward from the lower member 210 and can form the side surface of the container 200. The side wall 220 can be shaped as the side surface of a cylinder and can form the interior space 205 on its inner side. When the user manipulates a stick container 1000 according to an embodiment of the invention, the user would generally grip the side wall 220 of the container 200 with one hand. A sleeve 230 can be formed on an upper portion of the side wall 220.

The sleeve 230 may correspond to a portion of the side wall 220 of the container 200 that is hidden behind the below-mentioned outer member 420 of the connector 400. As the sleeve 230 of the container 200 is inserted between the inner cylinder 410 and the outer member 420 of the connector 400, the container 200 can be rotatably coupled to the connector 400. For easier coupling, the sleeve 230 can be formed in a smaller thickness compared to other portions of the side wall 220. Also, a detent protrusion 240 can be formed on an outer perimeter of the sleeve 230, and the detent protrusion 240 can be inserted in a detent indentation 440 formed in the inner perimeter of the outer member 420 of the connector 400. Thus, the container 200 can be coupled so as to be capable of rotation relative to the connector 400 while remaining undetached along the vertical direction.

The socket 250 can extend upward within the interior space 205 from the lower member 210 of the container 200. The socket 250 can have a cylindrical shape and can include an internal screw 260 on its inner side. The internal screw 260 can be formed on the inner side of the socket 250, with a groove formed in a helical shape in the manner of a female thread.

At a position on the inner side of the socket 250, a pressing protrusion 280 can be formed on the lower member 210. The pressing protrusion 280 can protrude upward in an upwardly convex shape. The pressing protrusion 280 can be formed in a position corresponding to an incision part 380 formed in the below-mentioned elongated body 350 of the shaft 300. A more detailed description on the role of the pressing protrusion 280 will be provided later on.

The shaft 300 may correspond to the part that interacts with the internal screw 260 of the container 200 and moves along the vertical direction according to a manipulation by the user. In an embodiment of the invention, the shaft 300 can include an elongated body 310, a neck 320, a head 340, gear cogs 360, and brake cogs 370.

The elongated body 310, serving as the main part of the shaft 300, can extend in an elongated manner along the vertical direction. The elongated body 310 can be arranged within the internal screw 260 of the socket 250 and can be configured to pass through the through-hole 465 of the connector 400. The elongated body 310 can have a cross section of a shape other than a circular shape such that the elongated body 310 is able to move along the vertical direction but is unable to rotate in relation to the connector 400. For example, in the embodiment illustrated in FIG. 1, the cross section of the elongated body 310 of the shaft 300 is longer in one direction, with the two longer sides of the cross section being flat and the two shorter sides of the cross section forming arc shapes. The gear cogs 360 and the brake cogs 370 can be located at a lower portion of the elongated body 310, and the neck 320 and the head 340 can be located at the upper end of the elongated body 310.

The neck 320 of the shaft 300 can extend upward from the upper end of the elongated body 310. The neck 320 can have a width smaller than the width of the elongated body 310 and can support the head 340, which may be formed on an upper portion of the neck 320.

The head 340 of the shaft 300 can be formed on an upper portion of the neck 320. The head 340 can have a width greater than the width of the neck 320 of the shaft 300 so as to protrude outward from both sides of the neck 320, and thus securing indentations 330 can be formed on both sides of the neck 320, between the upper end of the elongated body 310 and the lower surface of the head 340. As illustrated in FIG. 2, an embodiment of the invention can be designed such that the width of the head 340 is not greater than the width of the elongated body 310 in any direction. This will allow the head 340 and elongated body 310 of the shaft 300 to easily pass through the below-mentioned through-hole 465 of the connector 400. However, it would be possible to design the head 340 to have a width greater than the width of the elongated body 310 within a range that allows the mounting of the shaft 300.

The gear cogs 360 can protrude outward from both sides of the outer perimeter at a lower portion of the elongated body 310. That is, the gear cogs 360 can be formed on the shorter sides forming the arcs at a lower portion of the elongated body 310. At the position where the gear cogs 360 are formed on both sides, the shaft 300 can have a width corresponding to the width of the internal screw 260, as illustrated in FIG. 2A. Although it can be advantageous to form the gear cogs 360 at a lower portion of the elongated body 310 in terms of maximizing the movement range of the shaft 300, it would be possible to form the gear cogs 360 at various other positions on the elongated body 310.

The shaft 300 can be arranged such that the gear cogs 360 interlock with the internal screw 260 within the socket 250. When the container assembly 100 is rotated by user manipulation, the internal screw 260 may rotate as a part of the container 200, whereas the shaft 300 may not rotate together due to the elongated body 310 that is arranged not to rotate. As the internal screw 260 is rotated, the gear cogs 360 interlocked therewith may move along the internal screw 260. Since the shaft 300 is unable to rotate, the gear cogs 360 and the shaft 300 may move along the vertical direction without rotating.

The brake cogs 370 can protrude outward from positions other than the positions of the gear cogs 360 at a lower portion of the elongated body 310. For example, the brake cogs 370 can be formed on the longer sides forming the flat surfaces at a lower portion of the elongated body 310. The brake cogs 370 can be formed in a smaller size compared to the gear cogs 360. The brake cogs 370 can be formed such that, during normal operation, the brake cogs 370 do not contact the internal screw 260 or at least do not hinder the rotation of the socket 250 relative to the shaft 300, as illustrated in FIG. 2B.

An incision part 380 can be formed in a lower portion of the elongated body 310. As illustrated in FIG. 1 and FIG. 2A, the incision part 380 can be implemented in the form of a slit-shaped incision continuing to the lower end of the elongated body 310, so that the lower portion of the elongated body 310 may be spread outward in both directions with respect to the incision part 380. The gear cogs 360 and the brake cogs 370 can be formed on both sides of the incision part 380. The incision part 380 can be formed at a position that would correspond to the pressing protrusion 280 when the shaft 300 is inserted to the inner side of the socket 250. A more detailed description on the roles of the pressing protrusion 280 and the incision part 380 will be provided later on.

The connector 400 corresponds to the part that connects the container assembly 100 and the lift shell assembly 500 to each other. In an embodiment of the invention, the lift shell assembly 500 by itself can form a refill unit 550, and when the content is depleted in a stick container 1000, the lift shell assembly 500 with the depleted content can be replaced with a separate refill unit 550. To this end, the connector 400 can be configured to detachably couple the lift shell assembly 500 to the container assembly 100. The connector 400 can include an inner cylinder 410, an outer member 420, a connector base 460, and a connector coupler part 470.

The inner cylinder 410 can have the shape of a hollow cylinder that is open at the top and bottom, and a lower portion of the inner cylinder 410 can be inserted in the interior space 205 of the container 200. The inner cylinder 410 can be designed such that its outer diameter is of a value corresponding to the inner diameter of the container 200. Therefore, when the inner cylinder 410 is inserted, the outer perimeter of the inner cylinder 410 can be arranged to contact the inner perimeter of the container 200. However, since the container 200 is to undergo rotation relative to the connector 400, it may be desirable to configure the structure such that there is no great friction between the outer perimeter of the inner cylinder 410 and the inner perimeter of the container 200.

As illustrated in FIG. 2A, FIG. 2B, and FIG. 5B, the inner cylinder 410 can have a thickness that decreases towards the bottom. This means that elastic deformation may occur more easily at a lower portion of the inner cylinder 410. Therefore, when the inner cylinder 410 is inserted into the open top of the container 200, the inner cylinder 410 may permit a slight deformation at first so as to be inserted more easily, and after a portion has been inserted and the inner cylinder 410 has been properly aligned, the portion of the inner cylinder 410 having an increased thickness may contact the container 200 so as to firmly secure the connector 400 onto the container 200.

The outer member 420 can have the overall shape of a hollow cylinder and can be connected to the inner cylinder 410 at an upper portion thereof. The outer member 420 can be designed to have an inner diameter that is greater than the outer diameter of the inner cylinder 410. As a result, a gap can be formed between the inner cylinder 410 and the outer member 420, and a ledge 430 can be formed at the portion where the outer member 420 is connected to the inner cylinder 410.

As already described above, the sleeve 230 of the container 200 can be inserted in and secured to the gap between the inner cylinder 410 and the outer member 420. In the inner perimeter of the outer member 420, a detent indentation 440 can be formed that is configured to receive the detent protrusion 240 of the sleeve 230. The detent protrusion 240 and the detent indentation 440 can prevent the connector 400 from becoming separated from the container 200 along the vertical direction while permitting the connector 400 to rotate in relation to the container 200. While the drawings illustrate an example in which the detent protrusion 240 is formed on the sleeve 230 of the container 200 and the detent indentation 440 is formed in the outer member 420 of the connector 400, it should be obvious that the locations of the detent protrusion 240 and the detent indentation 440 can be altered.

An upper portion of the inner cylinder 410 can extend upward beyond the ledge 430 to form an exposed part 450 that is exposed to the outside. The connector base 460 can be formed on the exposed part 450 so as to be positioned at a height slightly above the ledge 430.

The connector base 460 can be formed at an upper portion of the inner cylinder 410, and a through-hole 465 through which the shaft 300 may pass can be formed in the connector base 460. The through-hole 465 can have a shape and size corresponding to the cross section of the elongated body 310. Since the cross section of the elongated body 310 is not of a circular shape, the elongated body 310 inserted through the through-hole 465 is prevented from rotating relative to the connector 400. In cases where the head 340 of the shaft 300 is designed to have a width smaller than or equal to the width of the elongated body 310, the head 340 of the shaft 300 can also pass through the through-hole 465 without difficulty.

The connector base 460 can be formed to have a diameter greater than the diameter of the inner cylinder 410. Also, since the connector base 460 is formed on the exposed part 450 at a height above the ledge 430, the outer perimeter of the connector base 460 can protrude further outward compared to the outer perimeter of the exposed part 450, and this portion can serve as a detent protrusion that permits the coupling of the overcap 900.

The lower portion of the connector 400 may be configured to permit the rotation of the container 200 while maintaining contact with the container 200, and therefore it can be advantageous for the lower portion of the connector 400 to have a generally circular cross section, but there is no rotation required at portions of the connector 400 that do not contact the container 200. Thus, although the example illustrated in the drawings show the connector base 460 as having a circular shape, the connector base 460 in certain other embodiments of the invention can have a shape other than a circular shape.

The connector coupler part 470 can extend upward from the connector base 460 and can be formed to surround the area that includes the through-hole 465. That is, the connector coupler part 470 can extend upward from around the through-hole 465 and can form a coupling space 475 (see FIG. 6B) on its inner side. Here, the coupling space 475 refers to the space on the inner side of the connector coupler part 470, which is not a completely enclosed space. In the example illustrated in FIG. 1, the connector coupler part 470 has a smaller diameter compared to the connector base 460 and is formed along the edge of the connector base 460 in an area larger than a half of the connector base 460.

A connector curb 480 that protrudes inwardly can be provided at an upper portion of the connector coupler part 470. The connector coupler part 470 can be open at the side facing the second direction and can be formed in an area that includes the entire half of one side of the connector base 460. That is, the connector coupler part 470 can be shaped as if the side facing the second direction (the other side) is cut and removed, as illustrated in the drawings. Thus, the coupling space 475 formed on the inner side of the connector coupler part 470 can be open upward at the inner side of the connector curb 480 and can also be open towards the second direction at the open side of the connector coupler part 470.

On the side surfaces on the side of the connector coupler part 470 facing the second direction, contact surfaces 490 can be formed facing the second direction. That is, the other side (side facing the second direction) of the connector coupler part 470, including the connector curb 480, can be shaped as if it were cut away along a plane, and this can form the contact surfaces 490. The contact surfaces 490 can be formed in a sloped angle with respect to the connector base 460. The contact surfaces 490 of the connector coupler part 470 can be configured to contact the below-mentioned stopper surfaces 690 of the stopper block 680.

Detent indentations 482 can be formed in the inner perimeter of the connector curb 480. A detent indentation 482 can be formed in a concave shape by way of a gradual curve. When the lift shell assembly 500 is coupled to the container assembly 100, the below-mentioned detent protrusions 662 of the shell coupler part 660 may be inserted into the detent indentations 482 of the connector curb 480 to allow a stronger coupling.

In a preferred embodiment of the invention, the detent indentation 482 of the connector curb 480 can be formed on both sides with the through-hole 465 in the middle. For example, supposing that an imaginary center line divides the connector base 460 in half and passes through the through-hole 465, the connector coupler part 470 can be formed along the edge of the connector base 460 over an area that is larger than the half area located on one side of the center line, and the detent indentations 482 can be formed at the points where the center line meets the connector coupler part 470. Such points of the detent indentations 482 allow a firm coupling between the lift shell assembly 500 and the container assembly 100.

The lift shell assembly 500 of the stick container 1000 can house a content (not shown) such as a lipstick, lip balm, etc., in the form of a stick material and can move the stick material up or down as manipulated by the user to adjust the degree to which the stick material is exposed. The lift shell assembly 500 can serve as a refill unit 550 according to an embodiment of the invention, and when the content is depleted in a stick container 1000, the lift shell assembly 500 with the depleted content can be replaced with a separate refill unit 550. Thus, the lift shell assembly 500 can be configured to be detachably coupled to the connector 400 of the container assembly 100. The lift shell assembly 500 can mainly include a lift shell 600 and a holder 700.

The lift shell 600 can be shaped as a hollow cylinder overall and can define a shell space 605 on its inner side, where the holder 700 and a content (not shown) in the form of a stick material coupled to the holder 700 can be housed in the shell space 605. When using a stick container 1000 according to an embodiment of the invention, the user can grip the lift shell 600 with one hand, grip the container 200 with the other hand, and apply a manipulation of rotating the lift shell 600 and the container 200 in relation to each other. The lift shell 600 can include a shell cylinder 610, a shell coupler part 660, and a stopper block 680.

The shell cylinder 610 may serve as the main part of the lift shell 600 and can be shaped as a hollow cylinder. That is, the shell cylinder 610 can be shaped to enclose and surround the holder 700 and the stick material held within the shell space 605. The shell cylinder 610 can be open at the top and can have a lower surface 620 at the bottom that defines the bottom of the shell space 605, where an insertion hole 630 can be formed in the lower surface 620 of the shell cylinder 610. The name "shell cylinder" is used merely for convenience. That is, although the expression "cylinder" implies a cylindrical shape, certain components of the stick container 1000 that do not rotate can have shapes other than circular shapes, as already described above, and the shell cylinder 610 can also be implemented in the shape of a column other than a cylinder.

The holder coupler part 740 of the holder 700 can be inserted in the insertion hole 630 formed in the lower surface 620 of the shell cylinder 610. As described later on, the holder coupler part 740 can be formed in a size smaller than that of the holder body 710, and the insertion hole 630 can be formed in a shape and size that allows the holder coupler part 740 to pass through. Of course, even if the insertion hole 630 is formed larger in size than the holder body 710, it is still possible to configure the holder body 710 to be unable to pass through the insertion hole 630 due to the structure of the platter 720 and outer wall 730, etc. However, if the size of the insertion hole 630 is made smaller than the size of the holder body 710, the lower surface 620 of the shell cylinder 610 can be made to support the weight of the holder body 710, and this can allow the platter 720, outer wall 730, etc., of the holder 700 to be free of large weight loads. In cases where the insertion hole 630 is made smaller in size than the holder body 710, an alignment indentation 640 can be formed in a position corresponding to the holder body 710, in a portion of the lower surface 620 of the shell cylinder 610 where the insertion hole 630 is not formed, and the holder body 710 can be placed in the alignment indentation 640.

The length of the shell cylinder 610 can be designed such that, when the holder 700 is resting on the lower surface 620 of the shell cylinder 610, the distance from the upper end of the shell cylinder 610 to the upper surface of the platter 720 is smaller than or equal to the movable range of the shaft 300. That is, the distance from the upper end of the shell cylinder 610 to the upper surface of the platter 720 can be smaller than or equal to the length of the internal screw 260 along the vertical direction. Therefore, when the shaft 300 is raised to its maximum height by the manipulation of the user, the upper surface of the platter 720 can reach or move even higher beyond the position corresponding to the upper end of the shell cylinder 610.

Figure 6A:
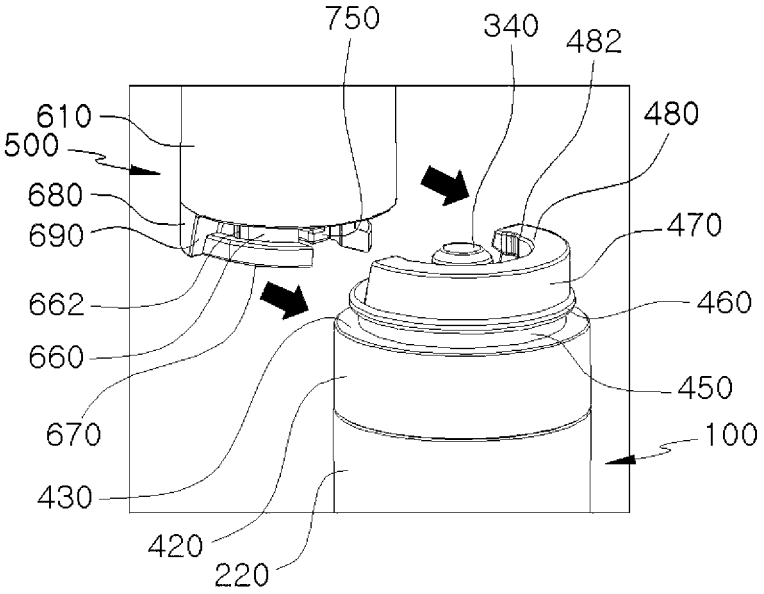
FIG. 6A and FIG. 6B are perspective views illustrating the coupling and separating of a refill unit in a stick container according to an embodiment of the invention.

The shell coupler part 660 can extend downward from the lower surface 620 of the shell cylinder 610 and can surround the area including the insertion hole 630. That is, the shell coupler part 660 can extend down from around the insertion hole 630 and can form an enclosing space 665 on its inner side. Here, the enclosing space 665 refers to the space on the inner side of the shell coupler part 660, which is not a completely enclosed space. The shell coupler part 660 can have a diameter smaller than that of the shell cylinder 610 and can be formed in a shape that opens to one side. That is, the shell coupler part 660 can be shaped as if a portion is cut and removed from one side (the side facing the first direction) over a width corresponding to the width of the head 340 of the shaft 300, as illustrated in FIG. 6A.

A shell curb 670 that protrudes outwardly can be provided at a lower portion of the shell coupler part 660. The shell coupler part 660 can have an open portion formed in one side, as illustrated in the drawings. Thus, the enclosing space 665 formed on the inner side of the shell coupler part 660 can be open downward and also open at the one side of the shell coupler part 660. The shell coupler part 660 including the shell curb 670 can have a shape corresponding to the inner side of the connector coupler part 470 including the connector curb 480.

Detent protrusions 662 can be formed on the outer perimeter of the shell coupler part 660. A detent protrusion 662 can be formed in a convex shape by way of a gradual curve. When the lift shell assembly 500 is coupled to the container assembly 100, the detent protrusions 662 of the shell coupler part 660 may be inserted into the detent indentations 482 of the connector curb 480 to allow a stronger coupling. The detent protrusions 662 can be formed in positions corresponding to the detent indentations 482 and can be formed at points on a plane that bisects the shell cylinder 610.

The stopper block 680 can extend downward from a lower portion at the other side (side facing the second direction) of the shell cylinder 610 and can surround the other side (side facing the second direction) of the shell coupler part 660. As illustrated in the drawings, the stopper block 680 can be shaped as if one side is cut and removed. The outer perimeter of the stopper block 680 can be shaped as a continuation of the outer perimeter of the shell cylinder 610, and the lower end of the stopper block 680 can be flush with the lower end of the shell coupler part 660. The stopper block 680 can be formed only on the other side (side facing the second direction) at the lower portion of the shell cylinder 610 and can have stopper surfaces 690 formed on the side surfaces facing the one side (the first direction).

In cases where portions of the stopper block 680 and the connector coupler part 470 are formed in arc-like shapes as in the example shown in the drawings, the radius of curvature of the outer perimeter of the stopper block 680 can be the same as the radius of curvature of the outer perimeter of the connector coupler part 470. The stopper surfaces 690 of the stopper block 680 can have the same slope as the contact surfaces 490 of the connector coupler part 470. When the lift shell assembly 500 is coupled to the container assembly 100, the stopper surfaces 690 can press against the contact surfaces 490, and the stopper block 680 and the connector coupler part 470 can form an integral shape.

The holder 700 can be arranged to be movable along the vertical direction within the shell space 605 in the lift shell 600 and can be configured to support a content (not shown) on its upper portion. The holder 700 can have a portion thereof exposed through the insertion hole 630 of the lift shell 600 so as to be coupled to the upper end of the shaft 300 when the lift shell assembly 500 is coupled to the container assembly 100. The holder 700 can include a holder body 710, a platter 720, an outer wall 730, a holder coupler part 740, and a securing piece 780.

The holder body 710 may correspond to the main part of the holder 700 and can be arranged in the shell space 605 on the inner side of the shell cylinder 610. When there is content filled in the lift shell assembly 500, the holder body 710 can rest on the lower surface 620 of the shell cylinder 610. The holder body 710 can be configured to not pass through the insertion hole 630 formed in the lower surface 620 of the shell cylinder 610 and, in certain embodiments, can be placed in the alignment indentation 640 formed in the lower surface 620 of the shell cylinder 610 as illustrated in the drawings.

The platter 720 can expand outward from the holder body 710 and can have an outer diameter corresponding to the inner diameter of the shell cylinder 610 within the range of vertical movement in the shell space 605. The content (not shown) in a solidified form can be arranged on the upper surface of the platter 720. In certain embodiments, the holder body 710 can be omitted, and the platter 720 can serve the role of the holder body 710. In this case, a portion of the platter 720 to which the holder coupler part 740 is connected can be regarded as the holder body 710.

The outer wall 730 can extend downward from edge of the platter 720. The outer wall 730 can be designed to have a sufficient length that allows the holder 700 to maintain a stable disposition within the shell space 605 and prevent the content (not shown) or other foreign substances from leaking downward. Since the holder 700 is a component that moves relative to the lift shell 600, it may be preferable that the holder 700 be configured such that there is no great friction between the inner perimeter of the shell cylinder 610 and the outer perimeter of the outer wall 730.

The outer wall 730 can be designed such that, when the holder 700 is resting on the lower surface 620 of the shell cylinder 610, the distance from the upper end of the shell cylinder 610 to the lower end of the outer wall 730 is greater than the movable range of the shaft 300. That is, the distance from the upper end of the shell cylinder 610 to the lower end of the outer wall 730 can be greater than the length of the internal screw 260 along the vertical direction.

Therefore, when the shaft 300 is raised to its maximum height by the manipulation of the user, the lower end of the outer wall 730 can remain below the upper end of the shell cylinder 610, and the holder 700 may not become detached from the lift shell 600.

The holder coupler part 740 can extend downward from the holder body 710. When the holder body 710 is resting on the lower surface 620 of the shell cylinder 610, the holder coupler part 740 can pass through the insertion hole 630 and be located within the enclosing space 665 on the inner side of the shell coupler part 660. However, the holder coupler part 740 itself can form a space on its inner side; the space on the inner side of the holder coupler part 740 is referred to herein as the holder space 745.

A holder curb 750 can be provided at a lower portion of the holder coupler part 740, where the holder curb 750 can protrude inwardly towards the holder space 745. Also, the holder coupler part 740 can be structured such that it is open at one side. Therefore, the holder space 745 formed on the inner side of the holder coupler part 740 can be open downward on the inner side of the holder curb 750 and can also be open towards the other side (the second direction) at the open other side of the holder coupler part 740.

The securing piece 780 can be formed on an upper portion of the holder body 710 at a position higher than the platter 720 and can have a greater diameter or a greater width along one or more directions compared to the holder body 710. The stick container 1000 and the refill unit 550 are for providing a content (not shown) produced in a solidified form, and the securing piece 780 can serve to secure the content. That is, the content can be provided as a solid, into which the securing piece 780 and portions of the holder 700 protruding above the platter 720 are buried therein. This can be achieved, for example, by providing a preparation in a fluid state such as a liquid or gel, etc., and congealing the preparation while the securing piece 780 is immersed in the preparation. When the content solidifies to form a stick material, the holder body 710, platter 720, and securing piece 780 can support the content in all directions and can thus prevent the content from becoming detached from the holder 700.

The overcap 900 of the stick container 1000 may serve to cover the exposed portion of the lift shell assembly 500 and store the content (not shown) in an unexposed state. The overcap 900 can be coupled to the container assembly 100 to complete the exterior of the stick container 1000.

When the overcap 900 is coupled to the container assembly 100, the exposed part 450 of the inner cylinder 410 of the connector 400 extending above the ledge 430 can be inserted to the inner side of the overcap 900, and the lower end of the overcap 900 can rest on the ledge 430 of the connector 400. A detent indentation can be formed in the inner perimeter of the overcap 900, and the connector base 460, which may protrude more outwardly than the exposed part 450, can serve as a detent protrusion that is inserted into the detent indentation. Such structure of the detent protrusion and detent indentation can enable a detachable coupling of the overcap 900 to the container assembly 100.

Figure 6B:
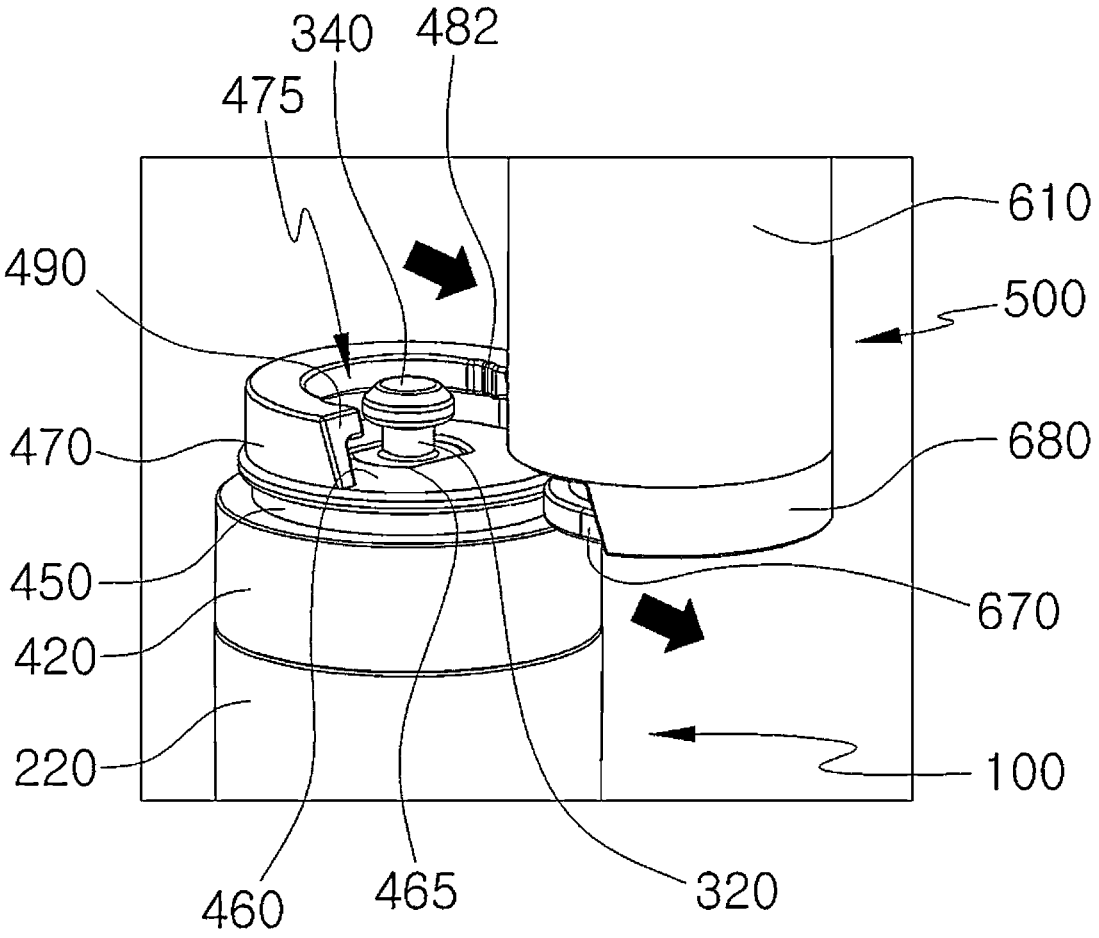
Figure 7A:
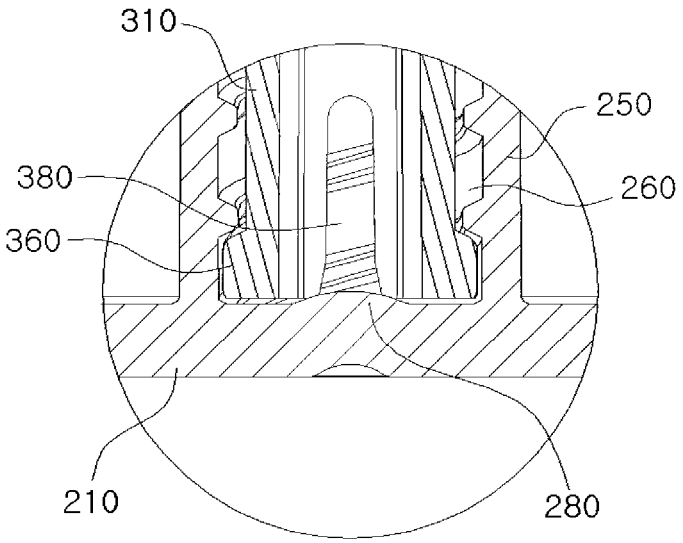
FIG. 7A and FIG. 7B are cross-sectional views illustrating the separating of a refill unit in a stick container according to an embodiment of the invention.
Figure 7B:
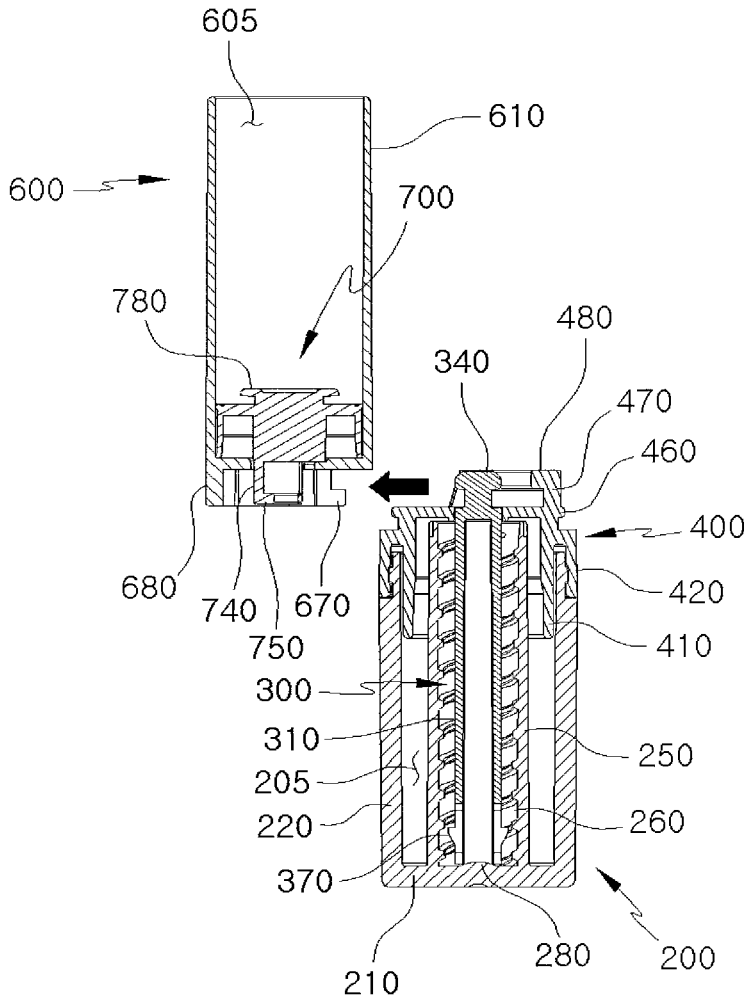

FIG. 6A and FIG. 6B are perspective views illustrating the coupling and separating of a refill unit 550 in a stick container 1000 according to an embodiment of the invention, and FIG. 7A and FIG. 7B are cross-sectional views illustrating the separating of a refill unit 550 in a stick container 1000 according to an embodiment of the invention. The following provides a more detailed description, with reference to FIG. 1 through FIG. 7B, of a method of coupling the lift shell assembly 500 onto the container assembly 100 in a stick container 1000 according to an embodiment of the invention and a method of using the stick container 1000.

As described above, when the content (not shown) is depleted in a stick container 1000 according to an embodiment of the invention, the user can replace the lift shell assembly 500 by using a separate refill unit 550. The refill unit 550 can be distributed, for example, with a refill cap 510 coupled onto the upper portion of the shell cylinder 610 of the lift shell 600 in the lift shell assembly 500, as illustrated in FIG. 3C. The user can remove the overcap 900 from the stick container 1000 with the depleted content, separate the lift shell assembly 500, remove the refill cap 510 from the refill unit 550, and couple the new lift shell assembly 500 to the existing container assembly 100.

Referring to FIG. 6A, the user can couple the lift shell assembly 500 of the new refill unit 550 to the container assembly 100. Although the inside of the lift shell 600 is not shown in FIG. 6A, the holder 700 would be positioned as low as possible, so as to be resting on the lower surface 620 of the shell cylinder 610, in the lift shell assembly 500 of the new refill unit 550, and a new supply of content would be provided on the holder 700 within the shell space 605 on the inner side of the shell cylinder 610.

When the lift shell assembly 500 is coupled on, the user can first arrange the lift shell assembly 500 such that the open side (facing the first direction) of the shell coupler part 660 faces the open side (facing the second direction) of the connector coupler part 470. Then, the user may move the lift shell assembly 500, corresponding to the refill unit, to one side (in the first direction) as in FIG. 6A, causing the components of the shell coupler part 660 and the connector coupler part 470 to mate with each other and be coupled. That is, the shell coupler part 660 including the shell curb 670 can be inserted into the coupling space 475 of the connector 400, and at the same time, the head 340 of the shaft 300 can be inserted into the holder space 745 of the holder 700.

In cases where detent indentations 482 and detent protrusions 662 are provided, the detent protrusions 662 may be caught on the connector curb 480 during the movement of the lift shell 600. If the user applies a greater force, the detent protrusions 662 may pass through, as the detent protrusions 662 and the connector curb 480 undergo slight elastic deformations, moving over the caught portions and entering the detent indentations 482 formed in the connector curb 480. Here, the stopper surfaces 690 of the stopper block 680 can press against the contact surfaces 490 of the connector coupler part 470.

When the detent protrusions 662 are thus inserted in the detent indentations 482, the lift shell assembly 500 is in a soundly coupled state with respect to the container assembly 100, where the outer perimeter of the shell coupler part 660 may contact the inner perimeter of the connector curb 480, and the shell curb 670 may be inserted between the connector curb 480 and the connector base 460 to contact the inner perimeter of the connector coupler part 470. Similarly, the inner perimeter of the connector coupler part 470 may contact the outer perimeter of the shell curb 670, and the connector curb 480 may be inserted between the lower surface 620 of the shell cylinder 610 and the shell curb 670 to contact the outer perimeter of the shell coupler part 660.

The shaft 300 can also be coupled with the holder 700, as the head 340 of the shaft 300 is soundly inserted into the holder space 745. Here, the holder curb 750 may be inserted between the upper end of the elongated body 310 and the lower surface of the head 340, and the holder body 710 may be positioned over the head 340, so that the movement of the shaft 300 in both the upward and downward directions can be transferred completely to the holder 700.

As described above, the user can couple the lift shell assembly 500 of the refill unit 550 onto the container assembly 100 by a simple action of snapping the lift shell assembly 500 towards one side. During this coupling process, there is no difficulty in coupling the connector coupler part 470, shell coupler part 660, etc., as these are firmly secured parts. However, since the shaft 300 is subject to slight movements in relation to the container 200 and the connector 400, it can be difficult to couple the head 340 of the shaft 300 to the holder 700 if shaking occurs. A stick container 1000 according to an embodiment of the invention may include a structure that can further secure the shaft 300 when the lift shell assembly 500 is coupled.

FIG. 7A is a magnified view of a lower part of FIG. 2A. As described above, a pressing protrusion 280 can be provided on the lower member 210 of the container 200 at an inner side of the socket 250. In the internal screw 260 on the inside of the socket 250, the shaft 300 can be arranged such that the incision part 380 in the lower end of the elongated body 310 is aligned with the pressing protrusion 280.

As described above, the user can move the shaft 300 up or down by holding the connector 400 with one hand, holding the container 200 with the other hand, and rotating the connector 400 and container 200 relative to each other. When the user applies a rotation as much as possible in the direction that lowers the shaft 300, the shaft 300 can move down until it reaches the lower member 210 of the container 200, and the shaft 300 can contact the pressing protrusion 280. As the shaft 300 moves down, the pressing protrusion 280 may contact the incision part 380 and may spread the lower end of the elongated body 310 apart in both directions with respect to the incision part 380.

The gear cogs 360 of the shaft 300 may normally be arranged to move along the internal screw 260, but when the lower end of the elongated body 310 is spread apart by the pressing protrusion 280, the gear cogs 360 may press against the inner surface of the internal screw 260, causing an increase in friction. Similarly, the brake cogs 370 of the shaft 300 may normally be arranged to not contact the internal screw 260, but when the lower end of the elongated body 310 is spread apart, the brake cogs 370 may contact the inner surface of the internal screw 260, also causing an increase in friction.

As the lower end of the elongated body 310 is thus spread apart by the pressing protrusion 280, the gear cogs 360 and the brake cogs 370 can press against the inner surface of the internal screw 260, and as a result, the shaft 300 can be secured without any shaking. As such, the user can insert the secure head 340 of the shaft 300 more easily into the holder space 745 and can easily insert the holder curb 750 into the securing indentations 330 between the upper end of the elongated body 310 and the lower surface of the head 340.

When the user wishes to use the stick container 1000, the user can remove the overcap 900, hold the lift shell 600 or the connector 400 with one hand, hold the container 200 with the other hand, and apply a manipulation of rotating the two in relation to each other. When the container 200 is rotated, the socket 250 of the container 200 may be rotated, but the shaft 300 may be restrained from rotating by the through-hole 465 of the connector 400. Therefore, the rotation of the internal screw 260 of the socket 250 can cause an upward movement of the gear cogs 360 of the shaft 300, which are engaged with the internal screw 260, in turn causing an upward movement also of the holder 700 coupled to the upper portion of the shaft 300 as well as the content (not shown) provided on the holder 700. The user can then use the portion of the content (not shown) that is exposed at the open top of shell cylinder 610 by rubbing the content on the required site.

When the user wishes to store the content after use, the user can rotate the container 200 in the opposite direction, upon which the shaft 300 and the holder 700 can move down again such that the upper end of the content (not shown) moves below the upper end of the shell cylinder 610. While the content lies unexposed at the open top of the shell cylinder 610, the user can again couple on the overcap 900.

With a prolonged use of the stick container 1000, the content provided in the form of a stick material would gradually be expended, from its upper end downward, and the shaft 300 may need to be used at a gradually increased height accordingly. Since the content is not held in a cup-shaped structure but is positioned in the form of a stick material on the upper surface of the platter 720 of the holder 700, the user can completely use up the content with nothing left over. When the user moves the shaft 300 to its maximum height, the upper surface of the platter 720 can be positioned at a height that is greater than or equal to the height of the upper end of the shell cylinder 610, while the lower end of the outer wall 730 of the holder 700 can remain positioned below the upper end of the shell cylinder 610, so that the holder 700 and the content can still be supported in a stable manner.

When the content is completely depleted and a replacement of the lift shell assembly 500 is needed, the user can rotate the container 200 to move the shaft 300 downward. When the shaft 300 is positioned as low as possible and the lower end of the elongated body 310 is spread apart by the pressing protrusion 280 as described above such that the shaft 300 is secure, the user can move the lift shell assembly 500 towards the other side (in the second direction) to separate the lift shell assembly 500 from the container assembly 100. Here, the head 340 of the shaft 300 can be separated from the holder 700 regardless of the angle to which it has rotated. The user can separate the refill cap 510 of another refill unit 550 as necessary and couple the new lift shell assembly 500 to the container assembly 100.

As set forth above, a stick container 1000 and a refill unit 550 according to certain embodiments of the invention make it possible for the user to completely use up the content of the stick container 1000 and afterwards refill the content for further use. This makes it possible to reuse the part of the stick container 1000 having a complicated structure, thereby allowing cost savings for both the consumer and the manufacturer, reductions in wasted resources, and also reductions in environmental pollution.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. A refill unit configured to be coupled to a container assembly by a movement in a first direction, the refill unit comprising:

a lift shell forming a shell space on an inner side thereof, the shell space being open in an upward direction; and a holder arranged to be movable along a vertical direction within the shell space, wherein the lift shell comprises:

a shell cylinder shaped as a hollow column to form the shell space on an inner side thereof, the shell cylinder having an insertion hole defined in a lower surface thereof; and a shell coupler part extending downward from the lower surface of the shell cylinder around the insertion hole to form an enclosing space on an inner side thereof, the shell coupler part having an outwardly protruding shell curb disposed on a lower portion thereof, the shell coupler part being open in the first direction such that the enclosing space is open in a downward direction and in the first direction, and wherein the holder comprises:

a holder body arranged within the shell space; and a holder coupler part extending downwards from the holder body to be inserted through the insertion hole into the enclosing space, the holder coupler part having a holder space defined on an inner side thereof and having an inwardly protruding holder curb defined on a lower portion thereof, the holder coupler part being open in the first direction such that the holder space is open in a downward direction and in the first direction.

2. The refill unit of claim 1, wherein the lift shell further comprises:

a stopper block extending downwards from a lower portion at a side of the shell cylinder facing a second direction, the stopper block surrounding a side of the shell coupler part facing the second direction, the stopper block having a stopper surface facing the first direction defined on a side surface thereof.

3. The refill unit of claim 1, wherein a detent protrusion is defined on an outer perimeter of the shell coupler part.

4. The refill unit of claim 1, wherein the insertion hole has a shape other than a circular shape such that the holder coupler part is able to pass through the insertion hole only when aligned in a particular direction.

5. A refillable stick container configured to be coupled with a refill unit moving in a first direction, the refillable stick container being configured to receive the refill unit at a side thereof facing a second direction, the refillable stick container comprising:

a container shaped as a hollow cylinder and forming an interior space on an inner side thereof, the interior space being open in an upward direction;

a shaft coupled to the container such that the shaft is movable along a vertical direction in relation to the container; and a connector coupled to an upper portion of the container and having a through-hole defined therein, the through-hole being configured to allow the shaft to pass therethrough, wherein the connector comprises:

a connector base having the through-hole defined therein; and a connector coupler part extending upward from the connector base around the through-hole to form a coupling space on an inner side thereof, the connector coupler part having an inwardly protruding connector curb defined on an upper portion thereof, the connector coupler part being open in the second direction such that the coupling space is open in an upward direction and in the second direction.

6. The refillable stick container of claim 5, wherein the connector coupler part has a contact surface facing the second direction defined on a side surface thereof, wherein the refillable stick container is configured to be coupled with the refill unit having a stopper block having a stopper surface facing the first direction, and wherein, when the refill unit is coupled, the contact surface is configured to be pressed against by the stopper surface.

7. The refillable stick container of claim 5, wherein the shaft comprises:

an elongated body extending along the vertical direction and having a cross section of a shape other than a circular shape;

a neck extending upward from an upper end of the elongated body and having a width smaller than a width of the elongated body; and a head disposed on an upper portion of the neck and having a width greater than the width of the neck, wherein the refillable stick container is configured to be coupled with the refill unit having a holder having a holder coupler part, the holder coupler part having a holder space defined on an inner side thereof, the holder coupler part having an inwardly protruding holder curb defined on a lower portion thereof, the holder coupler part being open in the first direction such that the holder space is open in a downward direction and in the first direction, and wherein, when the refill unit is coupled, the head of the shaft is configured to be inserted into the holder space.

8. The refillable stick container of claim 5, wherein the shaft comprises:

an elongated body extending along the vertical direction, the elongated body having a cross section of a shape other than a circular shape and having an incision part defined in a lower end thereof; and a gear cog protruding outward from a lower portion of the elongated body, wherein the container comprises:

a socket having an internal screw disposed in an inner side thereof; and a pressing protrusion protruding upward from a lower surface on an inner side of the socket at a position corresponding to the incision part.

9. A refillable stick container comprising:

a lift shell forming a shell space on an inner side thereof, the shell space being open in an upward direction;

a holder arranged to be movable along a vertical direction within the shell space, a container shaped as a hollow cylinder and forming an interior space on an inner side thereof, the interior space being open in an upward direction;

a shaft coupled to the container such that the shaft is movable along the vertical direction in relation to the container; and a connector coupled to an upper portion of the container and having a through-hole defined therein, the through-hole being configured to allow the shaft to pass therethrough, the connector being configured to be coupled to the lift shell, wherein the lift shell comprises:

a shell cylinder shaped as a hollow column to form the shell space on an inner side thereof and having an insertion hole defined in a lower surface thereof; and a shell coupler part extending downward from the lower surface of the shell cylinder around the insertion hole to form an enclosing space on an inner side thereof, the shell coupler part having an outwardly protruding shell curb defined on a lower portion thereof, the shell coupler part being open in a first direction such that the enclosing space is open in a downward direction and in the first direction, wherein the holder comprises:

a holder body arranged within the shell space; and a holder coupler part extending downwards from the holder body to be inserted through the insertion hole into the enclosing space, the holder coupler part having a holder space defined on an inner side thereof, the holder coupler part having an inwardly protruding holder curb defined on a lower portion thereof, the holder coupler part being open in the first direction such that the holder space is open in a downward direction and in the first direction, and wherein the connector comprises:

a connector coupler part extending upward around the through-hole to form a coupling space on an inner side thereof, the connector coupler part having an inwardly protruding connector curb defined on an upper portion thereof, the connector coupler part being open in the second direction such that the coupling space is open in an upward direction and in the second direction.

* * * * *